US007059694B2

(12) United States Patent
Nambudiri

(10) Patent No.: US 7,059,694 B2
(45) Date of Patent: Jun. 13, 2006

(54) METHOD AND SYSTEM FOR SECURING PRINTING PROCESS IN MAILING SYSTEMS WITH MULTIPLE PRINT HEADS

(75) Inventor: Easwaran Nambudiri, Rye Brook, NY (US)

(73) Assignee: Pitney Bowes Inc., Stamford, CT (US)

( * ) Notice: Subject to any disclaimer, the term of this patent is extended or adjusted under 35 U.S.C. 154(b) by 291 days.

(21) Appl. No.: 10/673,763

(22) Filed: Sep. 29, 2003

(65) Prior Publication Data

US 2005/0068356 A1 Mar. 31, 2005

(51) Int. Cl.
*B41J 3/00* (2006.01)

(52) U.S. Cl. ..... 347/2; 347/14; 347/1

(58) Field of Classification Search ..... 347/2, 347/1, 14; 101/91, 92, 93; 705/401
See application file for complete search history.

(56) References Cited

U.S. PATENT DOCUMENTS 5,467,709 A * 11/1995 Salomon ..... 101/93
5,730,049 A * 3/1998 Broschart ..... 101/91

* cited by examiner

*Primary Examiner*—Hai Pham
*Assistant Examiner*—Lam S. Nguyen
(74) *Attorney, Agent, or Firm*—Brian A. Lemm; Angelo N. Chaclas

(57) ABSTRACT

A method and system that improves the security of the printing process of postage evidencing on tape media in high speed mail processing systems having multiple print heads is provided. When the mailing machine is operating in the tape mode, printing of indicia is performed using only one print head. A record of which print head will print the indicium is maintained, and the print process is started when the tape is properly positioned under the correct print head. The tape media is moved past the print head at a speed slow enough to allow the single print head to print the complete indicium with sufficient resolution. Since only a single print head will be used to print an indicium on a tape, it is not possible to manipulate the tape to obtain two separate images of the same indicium.

23 Claims, 2 Drawing Sheets

METHOD AND SYSTEM FOR SECURING PRINTING PROCESS IN MAILING SYSTEMS WITH MULTIPLE PRINT HEADS

FIELD OF THE INVENTION

The invention disclosed herein relates generally to mail processing systems, and more particularly to a method and system for improving the security of the printing process of postage evidencing in mail processing systems that utilize multiple print heads.

BACKGROUND OF THE INVENTION

Mail processing systems, such as, for example, mailing machines, and the like, often include different modules that automate the processes of producing mail pieces. The typical mailing machine includes a variety of different modules or sub-systems each of which performs a different task on the mail piece. The mail piece is conveyed downstream utilizing a transport mechanism, such as rollers or a belt, to each of the modules. Such modules could include, for example, a singulating module for separating a stack of mail pieces such that the mail pieces are conveyed one at a time along the transport path, a stripping/moistening module for stripping open the flap of an envelope, and wetting and sealing the glued flap of an envelope, a weighing module for weighing the mail piece, and a metering/printing module for storing postage amounts and applying evidence of postage either directly to the mail piece or to a tape to be applied to the mail piece. The mailing machine is controlled by a central processing unit that executes software stored in memory provided in the mailing machine. The exact configuration of the mailing machine is, of course, particular to the needs of the user.

Mailing machines for printing postage indicia on envelopes and other forms of mail pieces have enjoyed commercial success, both in the U.S. Postal Service and in industry mail rooms and private office environments. Generally speaking, there are many different types of mailing machines, ranging from relatively small units, which handle only one mail piece at a time to large, multi-functional units, which can separate, feed, weigh, print postage indicia on and stack thousands of mail pieces per hour in a continuous stream operation. Thus, the modern mailing machine plays an important role in facilitating the rapid and efficient movement and other handling of mail.

Mailing machines have traditionally been capable of printing postage indicia either directly on mail pieces, or on pieces of tape, which are then attached to mail pieces. Typically, the mailing machine is set to print the postage indicia on envelopes as they are fed seriatim along a feed deck by a suitable feeding mechanism, the printing operation being carried out by a printing device that is part of a postage meter component of the mailing machine. The postage meter component has various control devices by which it can be set to print a predetermined amount of postage, together with other settable information, such as a date, within a pre-set design, the selectable information and the pre-set design all constituting the aforementioned postage indicia.

Many mailing machines currently utilize digital printing technology to print images in the form of indicia that evidences payment of postage on mail pieces. Digital printing technology includes thermal ink jet (bubble jet), piezoelectric ink jet, thermal printing techniques, and LED and laser xerographic printing that all operate to produce images by dot-matrix printing. In dot-matrix ink jet printing individual print elements in the print head (such as resistors or piezo electric elements) are either electronically stimulated or not stimulated to expel or not expel respectively, drops of ink from a reservoir onto a substrate. Thus, by controlling the timing of the energizing of each of the individual print elements in conjunction with the relative movement between the print head and the mail piece, a dot-matrix pattern is produced in the visual form of the desired indicia.

Regardless of which type of printing device is utilized in the postage meter, as noted above it is sometimes necessary to print the postage indicia on a strip of tape, either gummed or adhesive backed, because it is not possible to feed the mail piece on which it is desired to apply the postage indicia through the mailing machine. In many situations, for example, the mail piece may be too thick or too large in area, such as, for example, a parcel or package, to be fed through the normal feeding path of the mailing machine, or it may contain delicate material that could be damaged by the pressure exerted by the transport device of the mailing machine. Thus, there are numerous occasions in the normal operating situations of a mailing machine where the postage indicia simply cannot be applied directly to the mail piece and must be applied to a strip of tape, which is then suitably adhered to the mail piece.

There are problems, however, with the use of conventional digital printing technology, especially in mailing systems with very high throughputs. The ink ejection process, as described above, is physically limited by inherent frequency constraints. For example, the timing of the energizing of each of the individual print elements is limited within a maximum firing cycle for the print element. If the print medium is moving very fast, as in high throughput mailing systems, it may not possible to print an image with sufficient resolution that will not be distorted because the print elements of the print head cannot be energized quickly enough to keep pace with the movement of the print medium. To overcome this problem, high throughput mailing systems have been provided with multiple print heads, separated by some distance, typically several inches, which print in cooperation with each other to form a final image. In such systems, for example, the first print head will print all of the even columns of the image on the print medium, and the second print head will print all of the odd columns of the image on the print medium. Accordingly, the print process could be thought of as printing two separate copies of the image at half the horizontal resolution, and combining the images into a single image with the full horizontal resolution. Thus, by passing the print medium past both print heads, a complete image will be printed. By accurately controlling the firing of the second print head with respect to the first print head, a complete image can be printed that has sufficient resolution and is not distorted, regardless of the speed of the print medium.

While the use of multiple print heads solves the printing issue with respect to print medium that is moving very fast, it also introduces new problems. For example, since the printing process is essentially performed by printing two separate copies of the image at half the resolution, care must be taken to ensure that the two separate images cannot be printed on different media. This is especially true if the mailing machine is operating in the tape mode, i.e., where the indicia is printed on a strip of tape, as the tape is a flexible media that can be easily manipulated in the physical space between the print heads. If the same indicium can be printed on different pieces of tape (albeit in lower resolution), it is possible to defraud the postal authority of postage funds, since the indicium will have been accounted for only once, and can then be used to evidence payment of postage on two different mail pieces. This type of fraud is commonly referred to as "2 for 1" fraud.

Thus, there exists a need for improving the security of the printing process of postage evidencing on tape media in mail processing systems that utilize multiple print heads.

SUMMARY OF THE INVENTION

The present invention alleviates the problems associated with the prior art and provides a method and system that improves the security of the printing process of postage evidencing on tape media in mail processing systems. In accordance with the present invention, the printing of indicia, when the mailing machine is operating in the tape mode, is performed using only one print head. Preferably, the print heads are alternated between each indicium printed on a tape. The print control system maintains a record of which print head will print the indicium, and the print process is started when the tape is properly positioned under the correct print head. The tape media is moved past the print head at a speed slow enough to allow the single print head to print the complete indicium with sufficient resolution. Since only a single print head will be used to print an indicium on a tape, it is not possible to manipulate the tape to obtain two separate images of the same indicium, thereby preventing the occurrence of a "2 for 1" fraud.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PREFERRED EMBODIMENTS

Figure 1:
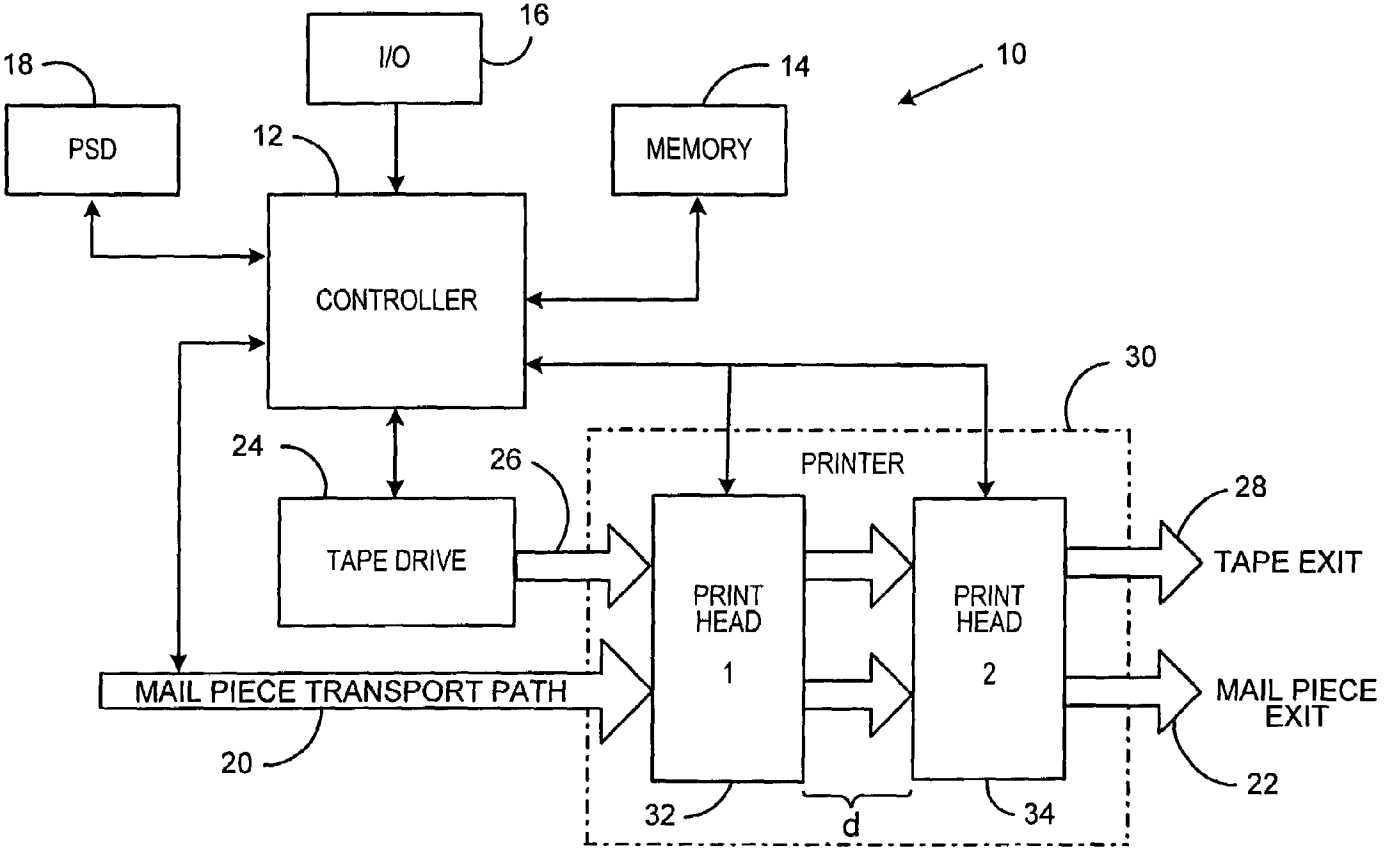
FIG. 1 illustrates in block diagram form portions of a mail processing system according to the present invention.

In describing the present invention, reference is made to the drawings, where there is seen in FIG. 1 in block diagram form portions of a mail processing system, such as, for example, a mailing machine 10, according to the present invention. While the present invention will be described with respect to a mailing machine 10, it should be understood that the present invention is not so limited and could be used with any type of mail processing system, such as, for example, an inserter system, in which an indicia for a mail piece is printed. Mailing machine 10 includes a controller 12 coupled to a memory 14 and a printer 30. Controller 12 may be, for example, a general or special purpose microprocessor or the like that executes instructions stored in memory 14 to control operation of the mailing machine 10. Controller 12 may be integral to the mailing machine 10, or may be a separate device coupled to the mailing machine 10. An input/output (I/O) device 16, such as, for example, a keyboard and display, are coupled to the controller 12. Optionally, the I/O device 16 and controller 12 may be combined in a single integrated unit coupled to the mailing machine 10. The controller 12 and I/O device 16 in combination perform the user interface and controller functions for the mailing machine 10. Specifically, they provide user interfaces, execute control of the mailing machine 10 and print operations performed by printer 30, calculate postage for debit based upon rate tables, provide the conduit for the Postal Security Device (PSD) 18 to transfer postage indicia to the printer 30, operate with peripherals for accounting and weighing, and conduct communications with a data center for postage funds refill, software download, rates download, and market-oriented data capture. The controller 12, in conjunction with PSD 18, provides the system meter that satisfies U.S. and international postal regulations regarding closed system information-based indicia postage (IBIP) meters.

Mailing machine 10 further includes a mail piece transport path 20 that transports the mail pieces in a downstream path of travel through the different modules of the mailing machine 10, such as, for example, printer 30. The movement of a mail piece (not shown) along the transport path 20 can be controlled by one or more pairs of drive/idler rollers (not shown) and/or by one or more belts (not shown) that move the mail piece through the mailing machine 10 along transport path in a conventional manner. Printer 30 can print a postage indicium, generated by controller 12, onto the mail piece as it is transported past. The mail piece will then exit the mailing machine at the mail piece exit 22. Mailing machine 10 further includes a tape drive 24 coupled to the controller 12. When the mailing machine is operating in a tape mode, the tape drive 24 will provide a tape or other type of adhesive label (hereinafter collectively referred to as tape) to printer 30, along processing path 26, upon which a postage indicium can be printed instead of printing the postage indicium on the mail piece. The tape exits the mailing machine 10 at tape exit 28 and can then be affixed to mail piece.

The printer 30 of mailing machine 10 is provided with two separate ink jet print heads 32, 34. The print heads 32, 34 may shuttle between the mail piece transport path 20, to print images on a mail piece being processed by the mailing machine 10, and the tape processing path 26, to print images on a tape. The print heads 32, 34 are separated by some distance d, such as, for example, two or three inches, in the direction parallel to the mail piece and tape transport. Thus, as illustrated, print head 34 is located downstream of print head 32 in the transport path 20 and processing path 26. Accordingly, a mail piece or tape will pass by the first print head 32 and then travel the distance d to pass by the second print head 34. During high speed printing, such as, for example, more than ten thousand mail pieces per hour, of mail pieces traveling along the mail piece transport path 20, the print heads 32, 34 print in cooperation with each other to print an indicium on the mail piece. For example, the first print head 32 can be used to print all of the even columns, i.e., columns 2, 4, 6, etc., in the image on the print medium, e.g., an envelope, and the second print head 34 can be used to print all of the odd columns, i.e., columns 1, 3, 5, etc., in the image on the print medium. Thus, by passing the print medium past both print heads 32, 34, a complete image will be printed.

Since the printing process is essentially performed by each print head 32, 34 printing a separate copy of an image at half the resolution, it is necessary to prevent the separate images from being printed on different media, thereby allowing a "2 for 1" fraud. This is especially true if the mailing machine 10 is operating in the tape mode, i.e., where the indicia is printed on a strip of tape, as the tape is a flexible media that can be easily manipulated in the physical space d between the print heads 32, 34. According to the present invention, this is prevented by utilizing only a single print head, i.e., either print head 32 or print head 34, to print the image when the mailing machine 10 is operating in the tape mode. To ensure sufficient resolution, without any distortion of the image, the speed of the tape drive 24 is reduced, as compared to the mail piece transport path 20, to provide the print head 32 or print head 34 with sufficient time to print the entire image, i.e., both even and odd columns, for the image being printed on the tape.

To prevent uneven wear between the print heads 32, 34, the printing process is preferably alternated between the print heads 32, 34 when the mailing machine 10 is operating in the tape mode. Thus, for example, print head 32 could be used to print the first, third, fifth, etc. tape, while print head 34 could be used to print every second, fourth, sixth, etc. tape. Alternatively, the selection of which print head 32 or 34 will be used to print the next image could be based on a predetermined pattern of usage. For example, print head 32 could be used to print five or ten tapes, and then print head 34 could be used to print the next five or ten tapes. Alternatively, the selection of which print head 32 or 34 will be used could be based on the day of the month, e.g., print head 32 prints on odd days and print head 34 prints on even days, the contents of one or more registers within the memory 14, or pseudo-randomly selected by the PSD 18. In this manner, both of the print heads 32, 34 will be used approximately the same amount, thereby preventing premature failure of one before the other. Controller 12 can be utilized to maintain print records for the print heads 32, 34, or simply whether print head 32 or print head 34 was last used. The print records can be utilized to determine which one of the print heads 32, 34 will be used to print the next image on a tape, and can cause the tape drive 24 to position the tape accordingly. Thus, if the print head 32 is going to be used to print the image, the controller 12 will cause the tape drive 24 to position the tape beneath the print head 32. Similarly, if the print head 34 is going to be used to print the image, the controller 12 will cause the tape drive 24 to position the tape beneath the print head 34.

Figure 2:
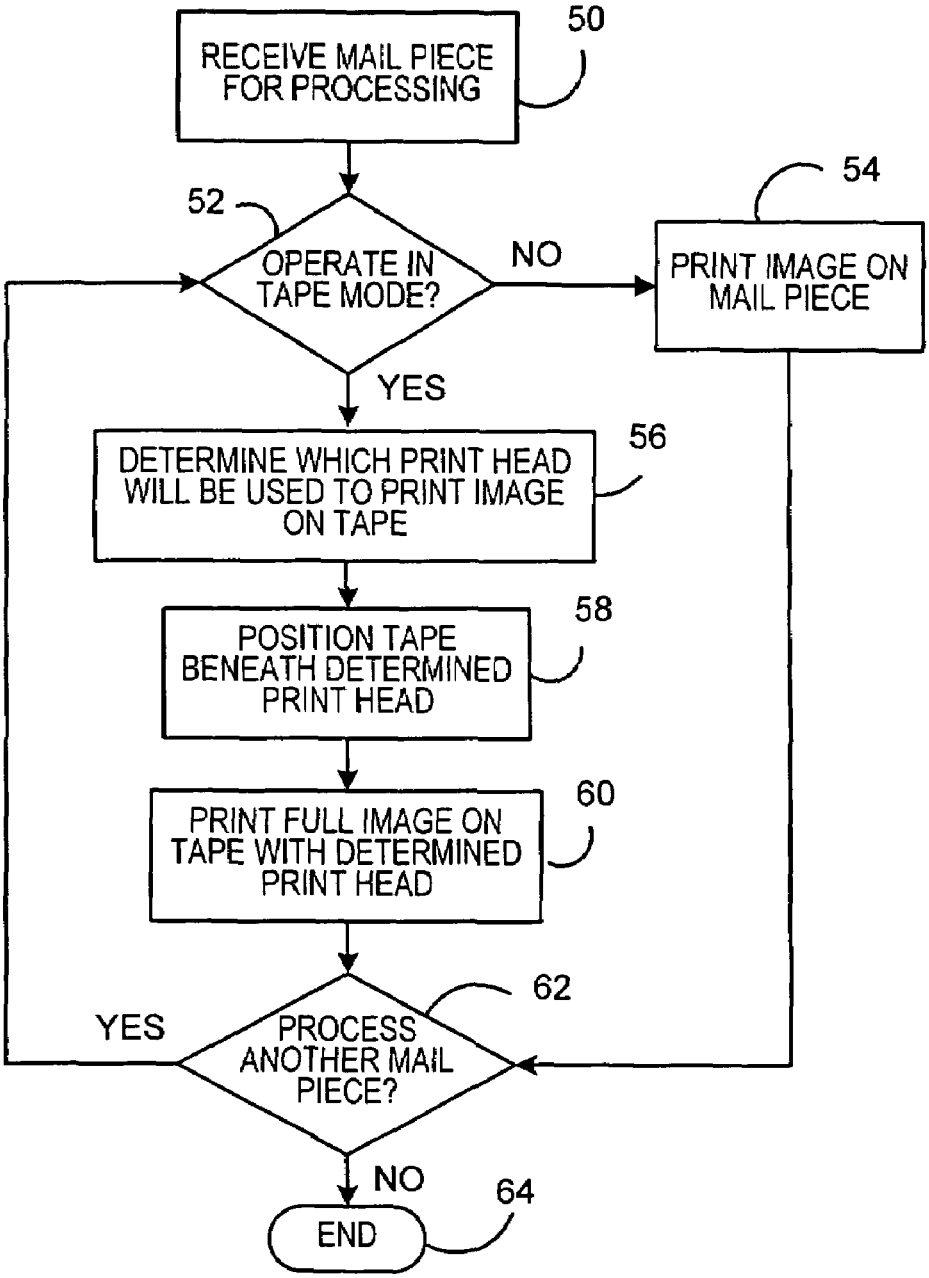
FIG. 2 illustrates in flow diagram form the operation of the mail processing system according to the present invention.

Referring now to FIG. 2, there is illustrated in flow diagram form the operation of the mailing machine 10 according to the present invention. In step 50, the mailing machine 10 receives a mail piece for processing. In step 52, it is determined if the mailing machine 10 will operate in the tape mode or not. This can be based upon a user input from I/O device 16 for each mail piece, or upon the mailing machine automatically determining that a tape will be printed based on the weight or dimensions of the mail piece. For example, if the dimensions and/or weight of the mail piece received for processing exceed maximum threshold limits, the print quality of the indicium printed on the mail piece may be so poor, due to the bulging of the mail piece, that it renders the indicium illegible. In this case, the mailing machine 10 may automatically enter the tape mode and print the indicium on a tape for affixing to the mail piece. It should be understood that in situations where the user desires to print a tape for a package or other oversize object that the mailing machine 10 can not process, step 50 need not be performed and the user can directly select the tape mode be entered in step 52. Additionally, if the user wishes to print tapes for a batch of mail pieces, step 52 need not be performed for each mail piece and instead the mailing machine 10 will automatically operate in the tape mode until reset by the user.

If in step 52 it is determined that the mailing machine 10 will not operate in the tape mode, then in step 54 the mailing machine 10 will continue to process the mail piece in the normal manner and print the image, i.e., an indicium evidencing payment of postage, directly on the mail piece utilizing both of the print heads 32, 34 as previously described. If in step 52 it is determined that the mailing machine 10 will operate in the tape mode, then in step 56 it is determined which print head, i.e., either print head 32 or print head 34, will be used to print the indicium on the tape. This determination can be performed, for example, by the controller 12, and can be based on a predetermined cycle for the print heads 32, 34 as previously described. For example, the print heads 32, 34 could be alternated. Once it has been determined which print head will print the indicium on the tape, then in step 58 the tape is positioned beneath the proper print head 32 or print head 34. This positioning can be performed, for example, by the tape drive 24 based on information from the controller 12. Once the tape has been properly positioned, then in step 60 the full image, i.e., both even and odd columns, are printed on the tape with the print head 32 or 34 determined in step 56. To ensure full resolution without any distortion of the image, the speed of the tape, as controlled by the tape drive 24, is reduced (as compared with the speed of the mail piece transport path 20) to allow only the single print head 32 or 34 to print the entire image.

Once the indicium image has been printed, either directly on the mail piece utilizing both print heads 32, 34 in step 54, or on a tape utilizing only a single one of the print heads 32 or 34 in step 60, then in step 62 it is determined if another mail piece is to be processed. If another mail piece is to be processed, then the processing continues at step 52. If another mail piece is not going to be processed, then at step 64 the processing ends.

Thus, according to the present invention, a method and system that improves the security of the printing process of postage evidencing on tape media in mail processing systems is provided. The printing of indicia, when the mailing machine 10 is in the tape mode, is performed using only one of print head 32 or print head 34. The tape media is moved past the print head 32 and/or 34 at a speed slow enough to allow the single print head 32 or 34 to print the complete indicium with sufficient resolution. Since only a single print head 32 or 34 will be used to print an indicium on a tape, it is not possible to manipulate the tape to obtain two separate images of the same indicium, thereby preventing the occurrence of a "2 for 1" fraud.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. In a mail processing system having a first and second print head for printing indicia, a method for processing a mail piece comprising:

determining if an indicium will be printed on the mail piece or on a tape;

if the indicium will be printed on the mail piece, printing the indicium on the mail piece utilizing both of the first and second print heads, each of the first and second print head printing a portion of the indicium; and if the indicium will be printed on a tape, determining which one of the first and second print head will be used to print the indicium on the tape, selecting the determined one of the first and second print head, and printing the indicium on the tape using the selected one of the first and second print head.

2. The method of claim 1, wherein determining which one of the first and second print head will be used to print the indicium further comprises:

determining which one of the first and second print head was last used to print an indicium on a tape;

selecting the first print head for use if the second print head was last used; and selecting the second print head for use if the first print head was last used.

3. The method of claim 1, wherein determining which one of the first and second print head will be used is based on a predetermined pattern of usage for the first and second print heads.

4. The method of claim 1, wherein determining which one of the first and second print head will be used is based on a date.

5. The method of claim 1, wherein determining which one of the first and second print head will be used is based on a pseudo-random selection.

6. The method of claim 1, wherein determining which one of the first and second print head will be used is based on a value of a register.

7. The method of claim 1, wherein printing the indicium on the tape using the selected one of the first and second print head further comprises:

positioning the tape such that the selected one of the first and second print head can print the indicium on the tape.

8. The method of claim 1, wherein the indicium is an image including odd and even columns, and the portion of the indicium printed by the first print head when the indicium is printed on the mail piece includes one of the even or odd columns and the portion of the indicium printed by the second print head includes the other of the even or odd columns.

9. A method for printing an indicium image in a mailing machine having a first and second print head, the indicium image being formed by columns and rows of dots, the method comprising:

printing all even columns of the indicium image with the first print head and all odd columns of the indicium image with the second print head when the indicium image is printed on a mail piece; and if the indicium image is printed on a tape, determining which one of the first and second print head will be used to print the indicium image, selecting the determined one of the first and second print head, and printing all even columns and all odd columns of the indicium image using only the selected one of the first and second print head.

10. The method of claim 9, wherein determining which one of the first and second print head will be used to print the indicium image further comprises:

determining which one of the first and second print head was last used to print an indicium image on a tape;

selecting the first print head for use if the second print head was last used; and selecting the second print head for use if the first print head was last used.

11. The method of claim 9, wherein determining which one of the first and second print head will be used is based on a predetermined pattern of usage for the first and second print heads.

12. The method of claim 9, wherein determining which one of the first and second print head will be used is based on a date.

13. The method of claim 9, wherein determining which one of the first and second print head will be used is based on a pseudo-random selection.

14. The method of claim 9, wherein determining which one of the first and second print head will be used is based on a value of a register.

15. The method of claim 9, wherein using the selected one of the first and second print head to print the indicium image on the tape further comprises:

positioning the tape such that the selected one of the first and second print head can print the indicium image on the tape.

16. A mail processing system comprising:

a first feed path for a mail piece;

a second feed path for a tape;

a first print head adjacent to the first and second feed paths;

a second print head adjacent to the first and second feed paths, the second print head being located downstream of the first print head;

a mail piece transport to transport a mail piece along the first feed path past the first and second print heads for printing an indicium thereon, each of the first and second print heads printing a portion of the indicium on the mail piece;

a tape drive to drive a tape along the second feed path past the first and second print heads for printing an indicium thereon, only one of the first and second print heads printing the indicium on the tape; and a controller coupled to the first print head, the second print head, and the tape drive, wherein the controller determines which one of the first and second print head will be used to print the indicium on the tape, and controls the tape drive to position the tape adjacent to the determined print head for printing of the indicium.

17. The mail processing system of claim 16, wherein the controller determines which one of the first and second print head will be used to print the indicium on the tape based on which one of the first and second print head was last used to print a previous indicium on a tape.

18. The mail processing system of claim 16, wherein the controller determines which one of the first and second print head will be used to print the indicium on the tape based on a predetermined usage pattern for the first and second print heads.

19. The mail processing system of claim 16, wherein the controller determines which one of the first and second print head will be used to print the indicium on the tape based on a date.

20. The mail processing system of claim 16, wherein the controller determines which one of the first and second print head will be used to print the indicium on the tape based on a pseudo-random selection.

21. The mail processing system of claim 16, wherein the controller determines which one of the first and second print head will be used to print the indicium on the tape based on a value of a register.

22. The mail processing system of claim 16, wherein the indicium is an image including odd and even columns of dots, and the portion of the indicium printed by the first print head when the indicium is printed on the mail piece includes one of the even or odd columns and the portion of the indicium printed by the second print head includes the other of the even or odd columns.

23. The mail processing system of claim 16, wherein the mail piece transport operates at a first speed, and the tape drive operates at a second speed, the second speed being slower than the first speed.

* * * * *